United States Patent [19]

Miller et al.

[11] 4,380,845

[45] Apr. 26, 1983

[54] NOZZLE FOR HAND-HELD VACUUM

[75] Inventors: Jonathan O. Miller, Howarth, N.J.; Kerry E. Strouse, Mill Hall; Richard M. Fegan, Montoursville, both of Pa.

[73] Assignee: Shop-Vac Corporation, Williamsport, Pa.

[21] Appl. No.: 245,892

[22] Filed: Mar. 20, 1981

[51] Int. Cl.[3] ..... A47L 5/24

[52] U.S. Cl. ..... 15/344; 15/327 F; 15/347; 15/352

[58] Field of Search ..... 15/344, 347, 352, 350, 15/327 R, 327 F, 327 E

[56] References Cited

U.S. PATENT DOCUMENTS

| | | | |
|---|---|---|---|
| 2,438,133 | 3/1948 | Sparklin | 15/327 F X |
| 2,960,713 | 11/1960 | Wistrand | 15/412 X |
| 3,246,359 | 4/1966 | Griffiths | 15/327 F X |
| 3,477,087 | 11/1969 | Robinson | 15/344 |
| 3,513,500 | 5/1970 | Hori | 15/344 |
| 3,667,084 | 6/1972 | Valbona et al. | 15/350 X |
| 4,209,875 | 7/1980 | Pugh et al. | 15/344 |

FOREIGN PATENT DOCUMENTS

| | | | |
|---|---|---|---|
| 2046130 | 3/1972 | Fed. Rep. of Germany | 15/344 |
| 598749 | 10/1959 | Italy | 15/344 |

*Primary Examiner*—Chris K. Moore

*Attorney, Agent, or Firm*—Ostrolenk, Faber, Gerb & Soffen

[57] ABSTRACT

A portable vacuum cleaner having a nozzle extending from the housing and a dust bag supported within the nozzle. The nozzle consists of two longitudinal sections one of which is an extension of the housing and the other of which is removable, to permit insertion, removal and replacement of the dust bag, and may also be locked in position. To lock the removable portion of the nozzle, there is a retainer for the housing end of the removable section and a tubular member which has a modified breech block type of locking flange at its front. The inner portion of the tubular member supports the dust bag in the nozzle. The locking flange is placed on a tab extending from the section of the nozzle which is an extension of the housing and receives a tab from the removable section of the nozzle. The locking flange is then rotated to effect the lock at the front end of the nozzle thereby locking the tubular member into the front end of the nozzle and locking the removable section of the nozzle in place. An end nozzle is provided having an opening communicating with its own tubular extension which is a removable fit into the tubular member which carries the locking flange. The end nozzle has an apron which covers the front end of the nozzle to cover the locking flange and present a smooth appearance.

12 Claims, 11 Drawing Figures

FIG. 9.
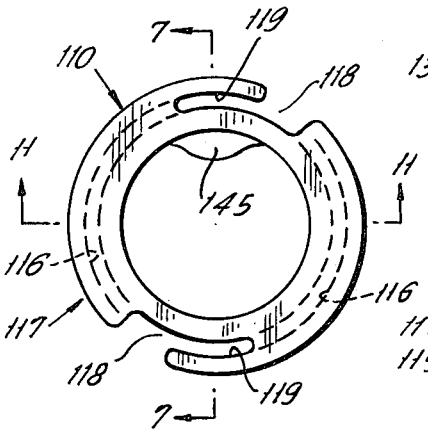
FIG. 7.
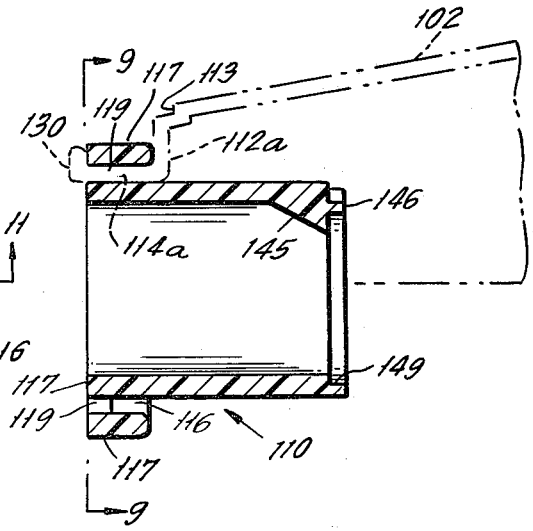
FIG. 8.
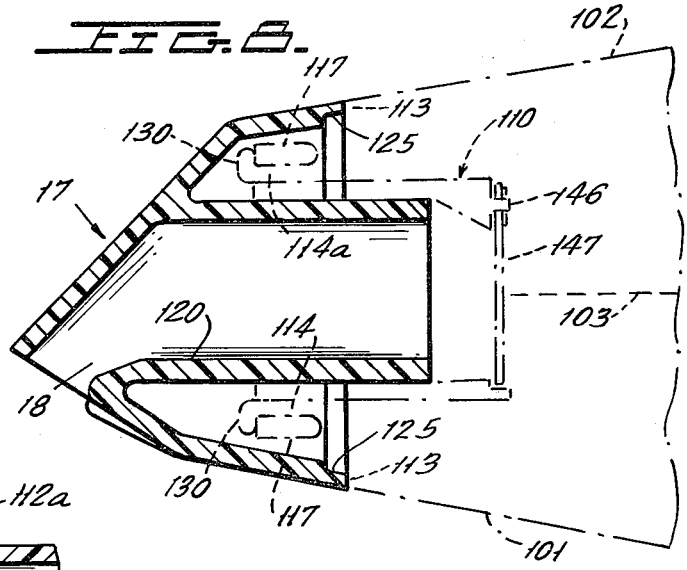
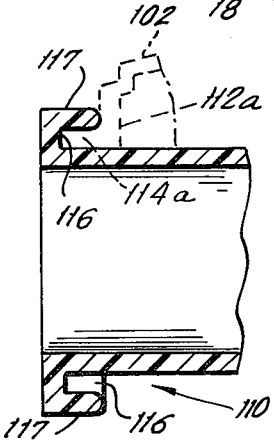
FIG. 11.

NOZZLE FOR HAND-HELD VACUUM

BACKGROUND OF THE INVENTION

The present invention relates to vacuum cleaners particularly of the hand-held type and more specifically relates to a longitudinally separable construction for an extended nozzle and nozzle end therefor which are arranged, not only to provide a nozzle opening with appropriate deployment of the suction stream, but also to provide and maintain in position a cover for that portion of the vacuum cleaner which holds a removable dust bag in position.

Heretofore hand-held vacuum cleaners have been so arranged that a principal housing was provided in which a motor and guide means for the cooling air for the motor and for the suction stream were provided as well as positioning appropriate filters or other means for extracting dust from the suction stream. A nozzle was extended from that housing to an opening which was arranged so that it could be presented to the surfaces to be cleaned. Where the dust bag was not provided exteriorly at the rear of the housing, but was included in the housing, or where filters were included in the housing, the housing was arranged so that it could be opened at one end or divided to provide access for the dust bag or filters contained within the housing.

SUMMARY OF THE INVENTION

The present invention comprises arranging the hand-held vacuum cleaner nozzle so that it may be integrated with the casing which houses the motor and suction guide means. Furthermore, the extended portion of the housing at the front of the vacuum cleaner, which ends in a pickup nozzle, provides means for including and supporting a filter member. The vacuum cleaner is provided with a releasable cover which is held in position by readily manipulated locking means. This locking means may also provide a support for the removable filter member.

By this means, the filter member may be readily inserted and removed in a portion of the vacuum cleaner which presents no mechanical or motor parts to the user and may be held in place by simplified internal structure and covered so that the air in the vacuum stream will exit through the desired passages.

It is an object of the invention to provide a housing facilitating installation of replacement filter members.

It is another object of the invention to provide an easily attached nozzle to a hand-held vacuum cleaner.

The foregoing and many other objects and features of the present invention will become apparent in the following description and drawings in which:

BRIEF DESCRIPTION OF THE DRAWINGS

FIG. 7 is an enlarged cross-sectional view of the nozzle end support sleeve contained within the front part of the nozzle housing.

FIG. 8 is a view partly in cross-section of the nozzle end inserted on the nozzle end support sleeve of FIG. 7.

FIG. 9 is an end view of the nozzle end support taken from line 9—9 of FIG. 7 looking in the direction of the arrows.

FIG. 11 is a cross-sectional view of the nozzle end of FIG. 9 similar to the view of FIG. 7 but at a different angle.

DESCRIPTION OF THE PREFERRED EMBODIMENT

Figure 1:
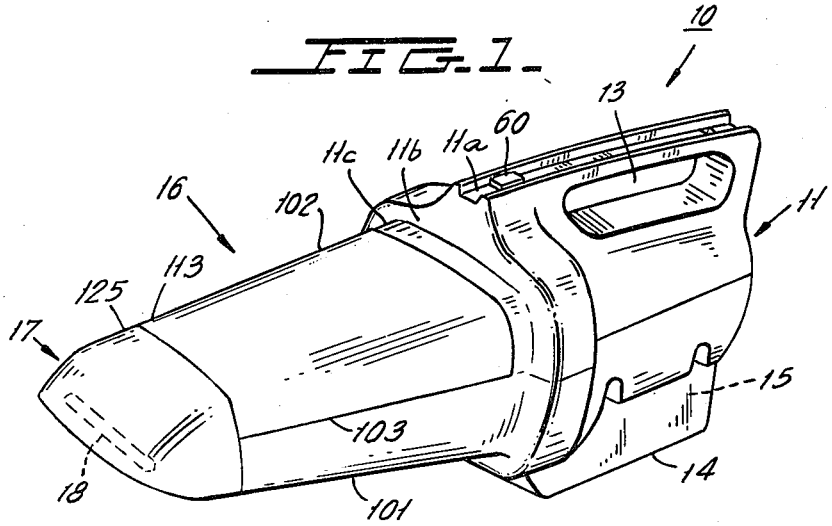
FIG. 1 is a view in perspective of the hand-held vacuum cleaner of the present invention.
Figures 2, 4, 5, 6:
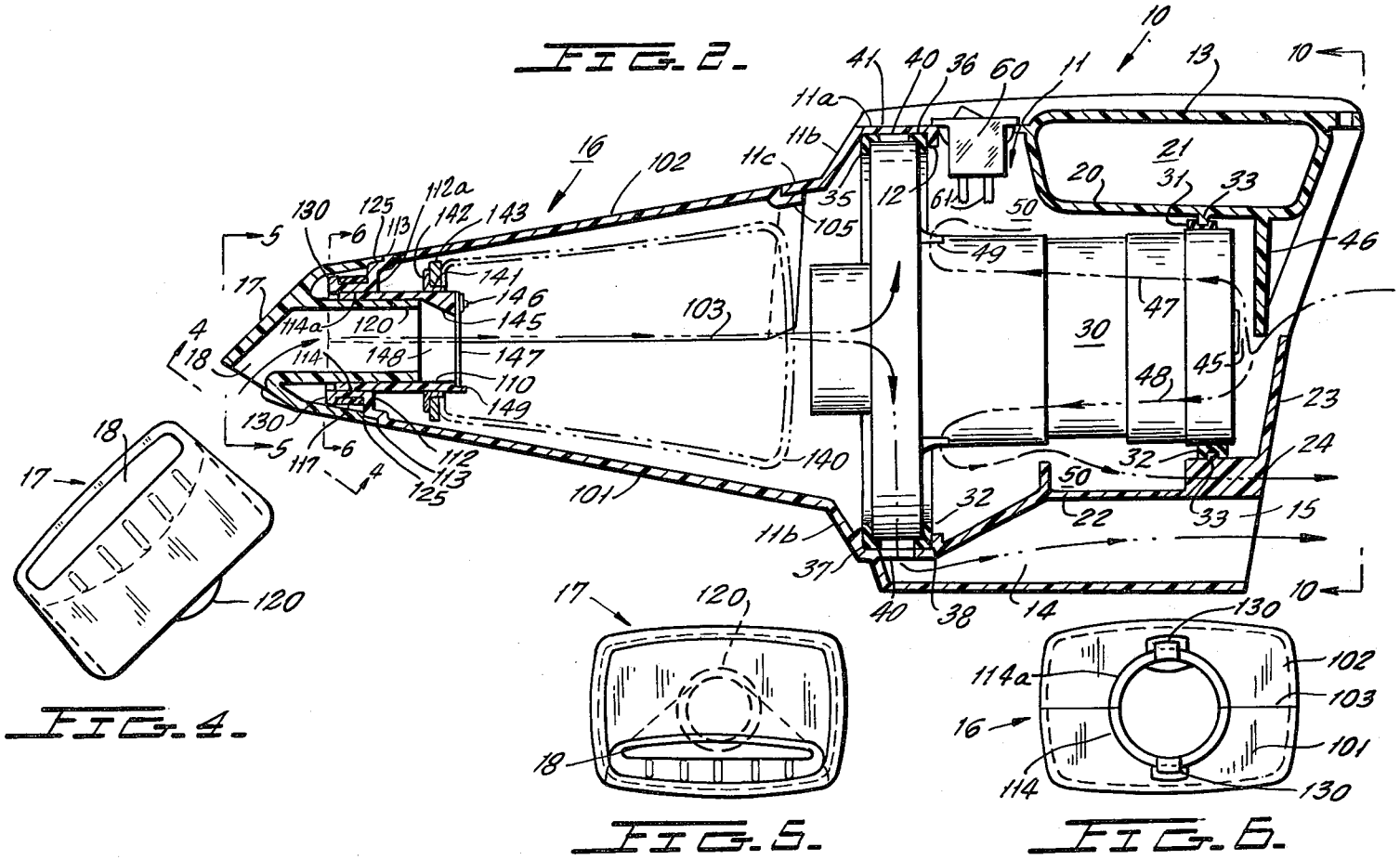
FIG. 2 is a longitudinal sectional view of the hand-held vacuum cleaner of FIG. 1.
FIG. 4 is a view in perspective of the nozzle end of the structure of FIGS. 1 through 3.
FIG. 5 is a front elevation of the nozzle end of FIG. 4 taken from line 5—5 of FIG. 2.
FIG. 6 is a cross-sectional view of the nozzle end taken from line 6—6 of FIG. 2 looking in the direction of the arrows.
Figure 3:
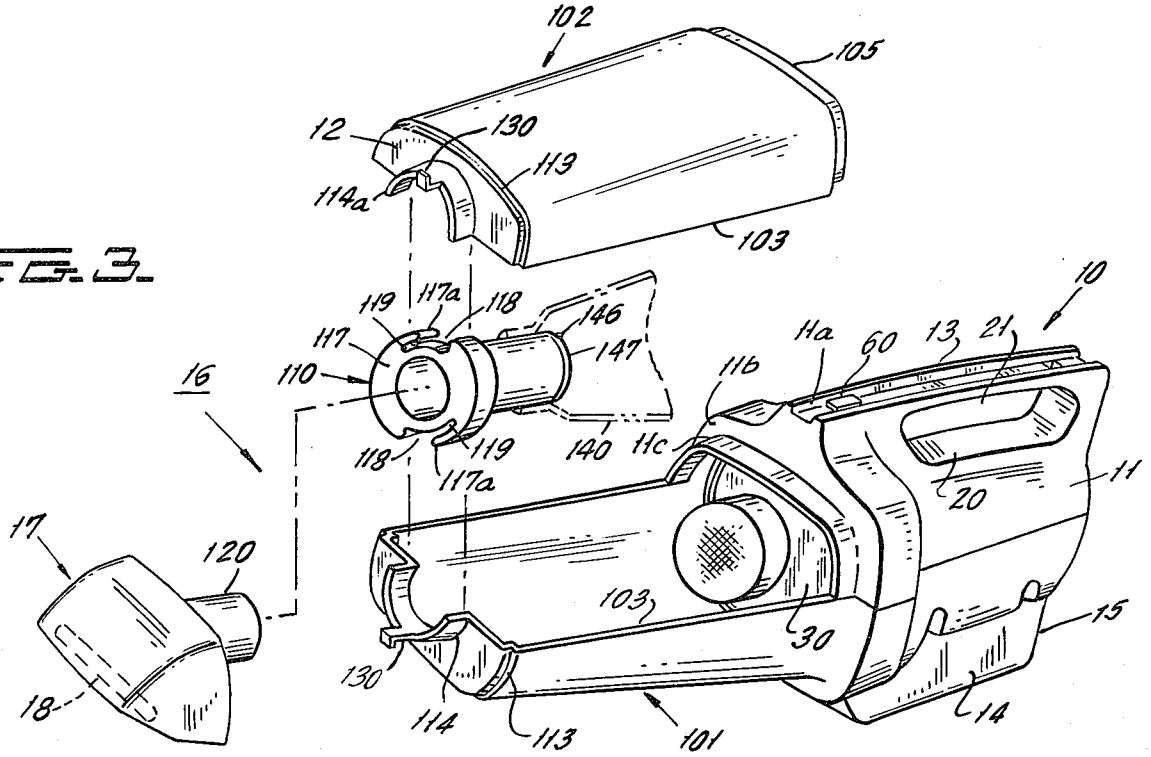
FIG. 3 is a partially exploded view in perspective of the hand-held vacuum cleaner of FIGS. 1 and 2.

Referring to FIGS. 1, 2 and 3, the main section 10 of the hand-held vacuum cleaner comprises a motor housing 11, a centrifugal fan housing 12, a handle 13 and exhaust passages 14 to the exhaust opening 15 for the suction air which is drawn in from the front end of the vacuum cleaner hereinafter described.

The main section 10 of the housing is connected as hereinafter described to an extended nozzle section 16 to which is attached the end nozzle 17, also as hereinafter described, to appropriately deploy the suction stream for the incoming air to provide cleaning suction at the opening 18 of the end nozzle 17.

The essential elements of the present invention inhere in the extended nozzle 16 and the end nozzle 17. However, the basic elements of the vacuum cleaner will first be described in order to provide the appropriate setting for the invention.

The housing 11 for the motor is recessed at the section 20 to provide hand-hold space 21 between the handle 13 and section 20 of the housing. The housing 11 for the motor is additionally provided with a support strut 22 terminating at one side in the end wall 23 and at the other side at the centrifugal fan housing 12 providing, in cooperation with the recess 20 of the housing 11 and the extension 24 of the support strut 22, support structure for bypass blower motor 30. The motor 30 is further supported by appropriate shock absorbing annular supports 31, 32 near the longitudinal ends of the motor housing. The support 31 engages an annular element 33 which continues from the base member 22 around to the underside of the recess 20 of the housing 11. The opposite end of the motor housing terminates at the centrifugal fan housing 12 and this housing in turn is supported by appropriate gaskets 35, 36 in the recesses 37, 38 of the housing 11.

Housing 11 is also provided with the switch 60 (and appropriate circuit elements 61) for operating the motor. The motor switch 60 is available for operation by the user when handle 13 is grasped.

Figure 10:
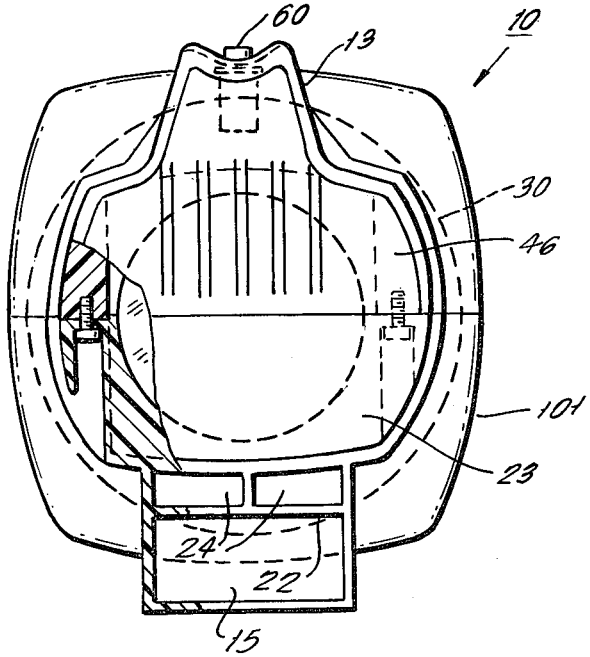
FIG. 10 is an end view of the rear of the novel vacuum cleaner taken from line 10—10 of FIG. 2.

The centrifugal fan housing contains a conventional centrifugal fan driven by the motor 30. The housing 12 is provided with peripheral exhaust openings 40. The exhaust openings 40 communicate with exhaust passage 14 (FIG. 2) to the exhaust opening 15 (FIG. 10).

The separate air flow for cooling the motor is drawn in through passage 45 defined by the back wall 23 of the lower half of the housing 11 and the inwardly spaced semi-circular wall 46 extending downwardly at the rear of the motor from the recessed section 20 of the housing 11. The air flows through the motor housing for cooling purposes in the direction shown by the arrows 47, 48 and exhausts from housing outlets 49 and through appropriate passages 50 directed toward the rear of the casing and through the ports 24.

The housing 11 is extended at 11*a* to provide an appropriate covering support for the fan housing. The housing 11 is further extended to form a conical annular extension 11*b* as shown in FIGS. 1, 2 and 3 to provide a connection to the principal nozzle.

The nozzle 16 has two sections, as seen most readily in FIG. 3. The nozzle 16 comprises the half conical section 101 which is connected to the wall of housing 11-11*a*-11*b* and the approximately half conical upper section 102 which may be released and even separated from section 101 and may be interconnected therewith and also with the half annular extension 11*c* which extends around the upper half of the housing 11 extending from the annular inwardly angled extension 11*b*.

The end nozzle 17 of the extended nozzle 16 is friction fit, as hereinafter described, in the interconnecting elements for the parts of the extended nozzle 16 and is encased by the interconnecting elements. The nozzle section 102, when secured to the nozzle section 101 along the seam 103, provides the extended nozzle 16.

The nozzle section 102 is provided with the step 105 that extends around the entire edge of the section 102. The step 105 fits under the half annular extension 11*c* of housing 11 and thus locks the rear end of the nozzle section 102 in place. The forward end of the nozzle section 102 is locked in place by the tubular sleeve 110 as hereinafter described. The bottom nozzle section 101 has a semicircular flange member 114 and the top nozzle section has a cooperating semi-circular flange member 114*a* which together define a circular sleeve for receiving the tubular sleeve 110.

The forward end of the sleeve 110 is surrounded by a flange 117 which is thickened radially and which is graspable for rotation of the sleeve and which includes radial slots 118 for initial installation of the flange members 114, 114*a* and adjacent circumferentially oriented slots 119 for interlocking with the members 114, 114*a* upon rotation of the flange and sleeve 110. There is an undercut circumferentially oriented groove 116 behind the flange 117 for receiving the flange members 114, 114*a*.

The sleeve 110 interlocks the members 114, 114*a* and also supports the dust bag 140. The cover member 102 is placed on the bottom section 101 of the nozzle, with the step 105 entering beneath the ledge 11*c*. Thereafter, the tubular sleeve 110 is driven inwardly through the circular opening created by the juxtaposition of the two flange members 114 and 114*a*. The radial slots 118 are provided in the flange 117 to permit bypassage of the radially outwardly directed forwardly projecting, L-shaped extensions 130 of the member 101 and the cover piece 102. The extensions 130 each have a forwardly directed leg with an outwardly directed tab at its end. The edges of the members 114, 114*a* enter into the groove 116 of the flange 117. The tabs 130 pass through the radial slots 118 of the flange 117 and the tabs 130 project forward to the front side of the flange 117 to the position shown in FIG. 7. Thereafter the flange 117 is rotated so that the radial slots 119 permit the flange member to extend in front of the flange 117. Thus, in opening the cover and removing the bag and replacing the bag the following operations occur.

The end nozzle 17 is pulled off exposing the flange 117 to view. Flange 117 is rotated to a position where the tabs 130 line up with the radial slots 118. The flange 117 and sleeve 110 are pulled forward a distance greater than the overlapping of extension 11*c* and step 105 for freeing their grip upon flange members 114, 114*a*. Then the top cover piece 102 is pulled forward, disengaging step 105 and extension 11*c* and the cover piece is free to be released and lifted off. The entire tubular member 110 may now be removed with the bag in place thereon. The filter member, i.e. dust bag 140, is removed. The new dust bag is installed over the tubular sleeve 110 and the tubular sleeve 110 carrying the bag is laid in the section 101 of the nozzle. The tubular member 110 is rotated so that the lower slot 118 registers with the tab 130 of section 101 of the nozzle. The upper section 102 is now reinstalled as above described and with its tab 130 registering with the upper radial slot 118 of the nozzle. The flange 117 is manually rotated in a clockwise direction with respect to FIG. 9 so that the tabs 130 enter the radial slots 119 and the unit is locked in place. The ends of members 114, 114*a* are completely contained within the flange 117. Coupled with the radial slots receiving the tabs 130, there is a complete interlock of the nozzle sections preventing any shifting of the top cover 102 of the nozzle section and any longitudinal shifting of the sleeve 110.

When the cover section 102 is placed on the section 101 of extended nozzle 16 in the position shown in FIG. 1 and 2 and is locked in position on the sleeve 110 as above described, then the extended cylindrical tube 120 of the end nozzle 17 may be inserted as a tight friction fit inside the sleeve 110 while the exterior, rear section 125 of the end nozzle 17 slides onto the step 113, at the forward end of the housing sections 101, 102. The rear section of the end nozzle 17 is sufficiently flexible to ensure a secure fit of section 125 on the step 113. The connection at 113, 125 rotationally fixedly orients the end nozzle 17 and also limits the extent of insertion of the tube 120. The cylindrical rearward extension 125 cooperates to hold the cover piece 102 of the nozzle in place.

As seen from FIGS. 4 and 5, the opening 18 is designed to deploy the stream of incoming suction air across the width of the nozzle for efficient vacuum operation.

The dust bag 140 is of generally conventional design, being provided with a friction fit opening section 141 which can be readily placed on the sleeve 110 or removed therefrom. Essentially, the section 141 comprises a re-entrant element 142 and an annular biasing member 143 which may be of any suitable material including, for instance, a circular rubber band, that will hold the section 141 of the dust bag 140 on the sleeve.

A portion 145 of the sleeve 110 is thickened at the rear end of the sleeve to provide for longitudinal insertion of a screw, rivet or other support 146 for the flapper valve 147 that covers the sleeve 110 and tube 120 and will prevent dust from leaking back from the dust bag 140 out through the opening 18 of the end nozzle section 17. The side 148 of the sleeve 110 opposite the thickened section 145 is provided with a recess 149 against which the lower end of the flapper valve 147 may rest, and it prevents accidental movement of the flapper valve 147 in the wrong direction.

It is thus possible to provide a simplified dust bag container for the hand-held vacuum cleaner which may readily be inserted and removed without obtaining access to any of the operating parts of the structure.

In the foregoing, the present invention has been described in connection with a preferred illustrative embodiment thereof. Since many variations and modifications will now be obvious to those skilled in the art, it is preferred that the scope of this invention be determined not by the specific disclosure herein contained, but only by the appended claims.

What is claimed is:

1. A vacuum cleaner comprising:

a main housing;

a suction fan mounted in said housing for drawing air into said housing; an air exhaust passage from said housing communicating with said suction fan; a motor in said housing for driving said fan;

said housing having a forward end; a nozzle extending rigidly from said forward end of said housing; an air inlet port at the end of said nozzle remote from said housing; said nozzle including a pair of sections extending longitudinally of said nozzle and defining an air passage between them from said air inlet port to said suction fan; a first one of said nozzle sections being secured to said housing; the second of said nozzle sections being releasably secured to said housing and to said first section;

a filter member housed within said nozzle for filtering the air passing through said nozzle and trapping particulate matter in said air;

said second section of said nozzle being openable to make said filter member in said housing accessible for insertion, removal and replacement;

a sleeve member at the forward end of said nozzle away from said housing; said sleeve member extending into said air passage; said sleeve member securing said nozzle sections together and preventing release of said second housing section from said first housing section;

said inlet port further comprising an end nozzle including a sleeve projecting into said sleeve member for positioning said end nozzle; said end nozzle including a support and positioning portion thereof around the periphery thereof for being lodged against said main housing to position said end nozzle.

2. A vacuum cleaner comprising:

a main housing;

a suction fan mounted in said housing for drawing air into said housing; an air exhaust passage from said housing communicating with said suction fan; a motor in said housing for driving said fan;

said housing having a forward end; a nozzle extending rigidly from said forward end of said housing; an air inlet port at the end of said nozzle remote from said housing; said nozzle including a pair of sections extending longitudinally of said nozzle and defining an air passage between them from said air inlet port to said suction fan; a first one of said nozzle sections being secured to said housing; the second of said nozzle sections being releasably secured to said housing and to said first section;

a filter member housed within said nozzle for filtering the air passing through said nozzle and trapping particulate matter in said air;

said second section of said nozzle being openable to make said filter member in said housing accessible for insertion, removal and replacement;

a sleeve member at the forward end of said nozzle away from said housing; said sleeve member extending into said air passage; said sleeve member securing said nozzle sections together and preventing release of said second housing section from said first housing section; securing means for releasably securing said sleeve member to both said nozzle sections; a portion of said housing is extended to form a ledge for receiving an end of said second section of said nozzle and for retaining said end of said second section against movement in a direction normal to the longitudinal axis of said nozzle.

3. The vacuum cleaner of either of claims 1 or 2, wherein said sleeve member includes a filter support in said air passage for supporting said filter member in said air passage.

4. The vacuum cleaner of claim 3, further comprising said filter member being in the form of a filter bag and being supported by said sleeve member in said air passage.

5. The vacuum cleaner of claim 2, wherein said sleeve member has an annular flange extending from the end thereof that is forward of the nozzle;

said securing means comprises said flange having a re-entrant locking section and further comprises said nozzle housing sections having means on the forward ends thereof which extend into said re-entrant locking section to receive and mount said sleeve member.

6. The vacuum cleaner of claim 5, further comprising an end nozzle having an opening for receiving air and having a sleeve corresponding in external dimensions to the internal dimensions of said sleeve member; said end nozzle sleeve being a frictional fit in said sleeve member.

7. The vacuum cleaner of claim 6, wherein said end nozzle includes a support and positioning portion thereof around the periphery thereof for being lodged against said nozzle section to position said end nozzle.

8. The vacuum cleaner of claim 5, wherein a portion of said housing is extended to form a ledge for receiving an end of said second section of said nozzle and for retaining said end of said second section against movement in a direction normal to the longitudinal axis of said nozzle.

9. The vacuum cleaner of claim 2, wherein said means at said forward end of each said section of said nozzle for extending into said re-entrant locking section comprises a respective L-shaped tab including a leg projecting forward of the respective said nozzle section and a tab section attached at the forward end of said leg and extending radially outwardly of said nozzle;

said re-entrant locking section comprising a radial slot on each opposite side of said sleeve member, and each said slot being positioned to receive one of said tabs;

a respective circumferential slot in said flange and communicating with each of said radial slots;

said sleeve member being positioned on said first section of said nozzle with said tab of said first nozzle section entering a said radial slot and with said tab section passing through and forward of said flange; said flange being thereafter rotatable to cause said circumferential slots to receive said legs of said tabs to move said tab sections away from said radial slots and to interconnect said sleeve member and said two nozzle sections.

10. The vacuum cleaner of claim 9, wherein said flange has a circumferential groove defined in the rearwardly facing side thereof for receiving the sleeve member therein when the tabs are entering and passing through the radial slots.

11. The vacuum cleaner of claim 9 or 10, further comprising an end nozzle having an opening for receiving air and having a sleeve corresponding in external dimensions to the internal dimensions of said sleeve member; said end nozzle sleeve being a frictional fit in said sleeve member.

12. The vacuum cleaner of claim 11, wherein said end nozzle includes a support and positioning portion thereof around the periphery thereof for being lodged against said nozzle sections to position said end nozzle.

* * * * *